US009045270B2

(12) United States Patent
Kimura et al.

(10) Patent No.: US 9,045,270 B2
(45) Date of Patent: Jun. 2, 2015

(54) CAULKING GUNS

(71) Applicant: MAKITA CORPORATION, Anjo-shi, Aichi (JP)

(72) Inventors: Kazuya Kimura, Anjo (JP); Manabu Sugimoto, Anjo (JP); Tokuo Hirabayashi, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 62 days.

(21) Appl. No.: 13/773,807

(22) Filed: Feb. 22, 2013

(65) Prior Publication Data

US 2013/0233893 A1 Sep. 12, 2013

(30) Foreign Application Priority Data

Mar. 8, 2012 (JP) ..... 2012-051435

(51) Int. Cl.

*B65D 88/54* (2006.01)
*B65D 83/00* (2006.01)
*B05C 17/01* (2006.01)

(52) U.S. Cl.

CPC ..... *B65D 83/0033* (2013.01); *B05C 17/0103* (2013.01)

(58) Field of Classification Search

CPC ..... B65D 88/54; B67D 7/60
USPC ..... 222/325–327, 390–391, 333; 74/84 R, 74/825–826
See application file for complete search history.

(56) References Cited

U.S. PATENT DOCUMENTS 3,854,629 A * 12/1974 Blieberger ..... 222/109
4,615,469 A 10/1986 Kishi et al.
4,669,636 A * 6/1987 Miyata ..... 222/153.01
4,986,454 A * 1/1991 Riley ..... 222/327
5,058,781 A * 10/1991 Aronie et al. ..... 222/326
5,775,539 A * 7/1998 Bates et al. ..... 222/1
5,871,299 A * 2/1999 Lai ..... 403/322.1
5,909,830 A * 6/1999 Bates et al. ..... 222/327

(Continued)

FOREIGN PATENT DOCUMENTS

EP 1 657 804 A1 5/2006
EP 2 527 045 A1 11/2012

(Continued)

OTHER PUBLICATIONS

Jul. 3, 2013 European Search Report issued in European Patent Application No. EP 13156749.7.

*Primary Examiner* — Paul R Durand
*Assistant Examiner* — Andrew P Bainbridge
(74) *Attorney, Agent, or Firm* — Oliff PLC

(57) ABSTRACT

An electric caulking gun may include a main body portion including a cartridge setting portion to which a cartridge containing a caulking material can be set, an electric motor disposed within the main body portion, and a push rod configured to be pressed against the cartridge for dispensing the caulking material from the cartridge. The push rod may be coupled to the electric motor so as to advance and retract along a moving path. The electric motor may extend in a right and left direction across a vertical plane including the moving path of the push rod.

4 Claims, 6 Drawing Sheets

(56) References Cited

U.S. PATENT DOCUMENTS

| | | | | |
|---|---|---|---|---|
| 6,123,325 | A * | 9/2000 | Buchanan et al. | 267/122 |
| 6,488,180 | B1 * | 12/2002 | Bayat | 222/137 |
| 6,540,113 | B2 * | 4/2003 | Gardos | 222/137 |
| 7,637,392 | B2 * | 12/2009 | Hsu et al. | 222/137 |
| 7,854,348 | B2 * | 12/2010 | Wang | 222/63 |
| 2010/0006605 | A1 * | 1/2010 | Sung et al. | 222/327 |

FOREIGN PATENT DOCUMENTS

| | | | |
|---|---|---|---|
| EP | 2 564 942 | A2 | 3/2013 |
| JP | A-58-137465 | | 8/1983 |
| JP | A-59-222251 | | 12/1984 |
| JP | A-6-47328 | | 2/1994 |
| JP | A-8-257465 | | 10/1996 |
| JP | B2-3598565 | | 12/2004 |

* cited by examiner

CAULKING GUNS

This application claims priority to Japanese patent application serial number 2012-051435, the contents of which are incorporated herein by reference.

BACKGROUND OF THE INVENTION

1. Field of the Invention

This invention relates to filling tools (so-called caulking guns) used mainly for repairing operations of building materials or the like for the purpose of waterproofing, such as repairing operations of cracks or gaps in the outer wall of a residential building and repairing operations of a joint between a bathtub and a wall surface of a bathroom, by filling materials, such as a silicon type filling material, (hereinafter simply referred to as caulking materials).

2. Description of the Related Art

For example, a caulking material known as a silicon sealant is commercially available on the market in a form of a cartridge filled with a fixed amount of the material. The cartridge may be set in a dedicated caulking gun to be used for the filling operation.

In general, the caulking gun includes a lever in the form of a trigger that can be pulled by the user grasping a handle portion of the caulking gun to move an push rod, whereby the caulking material can be extruded from a nozzle of the cartridge. In the case of this completely manual type caulking gun, great fatigue is involved as a result of the repetition of the extruding operation. In view of this, there has been provided an electric caulking gun using an electric motor as a drive source. Techniques related to this electric caulking gun are disclosed, for example, in JP-A-8-257465 (also published as Japanese Patent No. 3598565), JP-A-58-137465, and U.S. Pat. No. 4,615,469 (Also published as JP-A-59-222251). In the electric caulking guns as disclosed in these publications, the electric motor is started to move the push rod when a switch lever is operated to be turned on. Therefore, unlike the manual type caulking gun, in which the operation force of the lever generates the extrusion force, the user can easily perform the filling operation repeatedly.

However, in general, the cartridge is set to extend forward from the front central portion of a main body of the caulking gun. In this connection, the push rod is necessary to be set to extend in the advancing and retracting direction across the central portion with respect to the widthwise direction of the main body.

Due to this arrangement of the push rod, the electric motor is necessary to be position to project laterally from the main body by a relatively large distance, leading to unfavorable unbalance in weight of the caulking gun in the right and left direction.

Therefore, there has been a need in the art for a technique of improving the balance in weight of a may body of an electric caulking gun.

SUMMARY OF THE INVENTION

In one aspect according to the present teachings, an electric caulking gun may include a main body portion including a cartridge setting portion to which a cartridge containing a caulking material can be set, an electric motor disposed within the main body portion, and a push rod configured to be pressed against the cartridge for dispensing the caulking material from the cartridge. The push rod may be coupled to the electric motor so as to advance and retract along a moving path. The electric motor may extend in a right and left direction across a vertical plane including the moving path of the push rod.

DETAILED DESCRIPTION OF THE INVENTION

Figure 1:
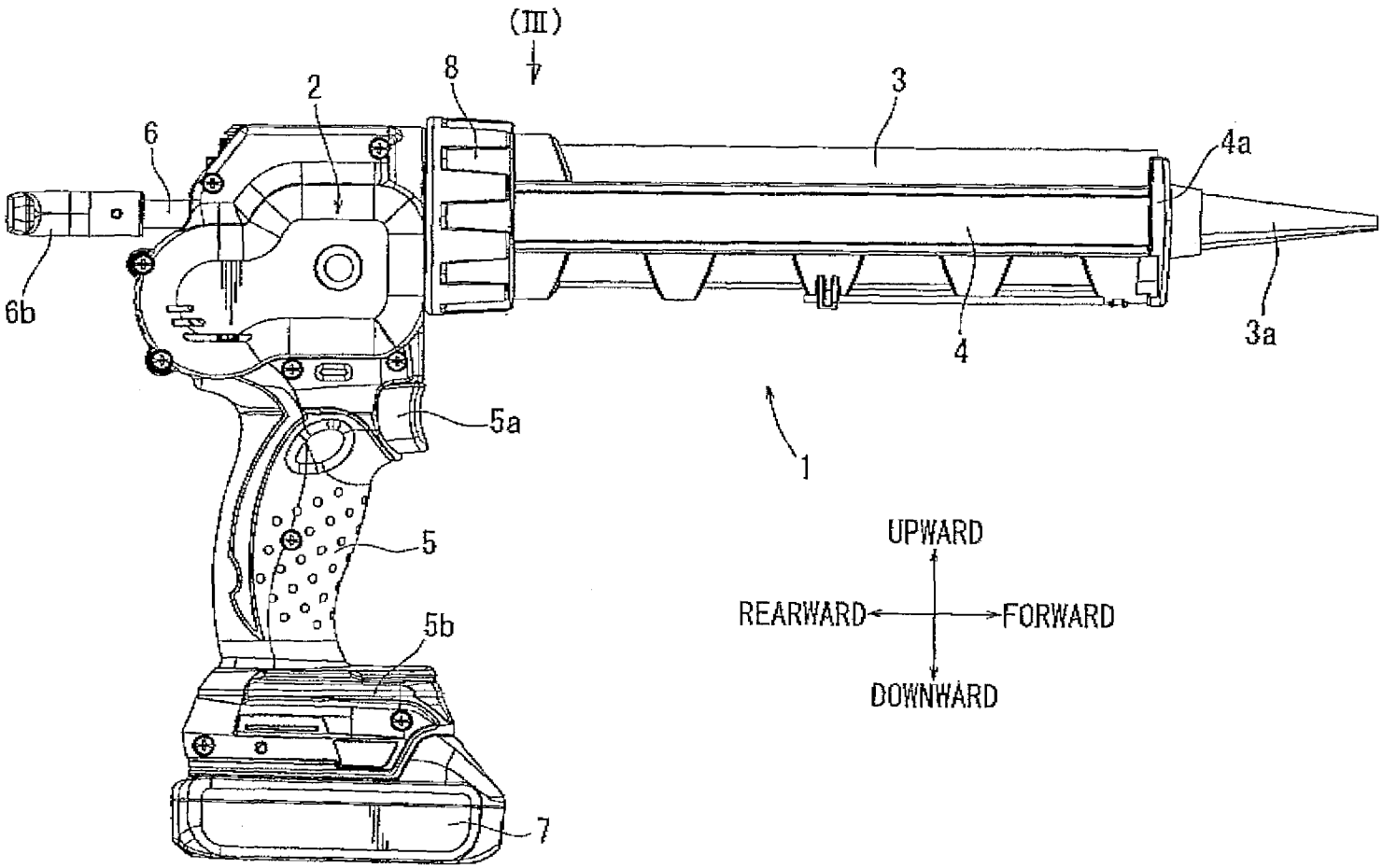
FIG. 1 is a side view of a caulking gun according to a representative embodiment showing a cartridge set in the caulking gun.

Each of the additional features and teachings disclosed above and below may be utilized separately or in conjunction with other features and teachings to provide improved caulking guns. Representative examples of the present invention, which examples utilize many of these additional features and teachings both separately and in conjunction with one another, will now be described in detail with reference to the attached drawings. This detailed description is merely intended to teach a person of skill in the art farther details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one embodiment, an electric caulking gun may include a main body portion including a cartridge setting portion to which a cartridge containing a caulking material can be set, an electric motor disposed within the main body portion, a drive gear rotatably driven about a gear axis by the electric motor, and a push rod configured to be pressed against the cartridge set at the cartridge setting portion to cause the caulking material to be dispensed from the cartridge. The push rod may have a rack meshing with the drive gear, so that the push rod advances and retracts along a moving path across a substantially central position with respect to a width in a right and left direction of the main body portion. The electric motor may be arranged parallel to the gear axis and may extend in the right and left direction across a vertical plane including the moving path of the push rod.

With this arrangement, it is possible to avoid imbalance in weight of the electric motor in the right and left direction with respect to the vertical plane of the push rod.

In addition the electric motor may not protrude laterally from the main body portion by a large distance. Therefore, the caulking gun can be easily handled, and the operability of the caulking gun can be improved.

The electric caulking gun may further include a plurality of reduction gear trains provided between the electric motor and the drive gear for reducing the rotation of the electric motor. The plurality of reduction gear trains may be disposed on the gear axis within the main body portion so as to extend in the right and left direction across the vertical plane including the moving path of the push rod.

With this arrangement of the plurality of reduction gear trains, the weight balance of the caulking gun with respect to the right and left direction can be further improved.

The rotation of the electric motor may be transmitted to the drive gear via the plurality of reduction gear trains along a power transmission path, in which the rotation of the electric motor is input to the plurality of reduction gear trains from one of right and left sides with respect to the vertical plane including the moving path of the push rod and is output from the plurality of reduction gear trains at a position on the other of the right and left sides, and the output of the plurality of reduction gear trains is transmitted to the drive gear at a position substantially centrally with respect to the width of the main body portion.

With this arrangement, it is possible to arrange a larger number of reduction gear trains on the gear axis, while minimizing the size of the main body portion in the widthwise direction.

In addition, it is possible to arrange the push rod such that the push rod extends substantially centrally with respect to the width of the main body portion.

The electric caulking gun may further include a belt-transmission type reduction mechanism provided between the electric motor and the plurality of reduction gear trains.

As compared with the gear mesh-engagement type reduction mechanism, the belt transmission type reduction mechanism can provide a higher reduction ratio without involving an increase in the distance between the output shaft of the electric motor and the drive shaft, so that it is possible to achieve a reduction in the size, mainly in the forward and rearward direction, of the main body portion and eventually the size of the caulking gun.

Figure 2:
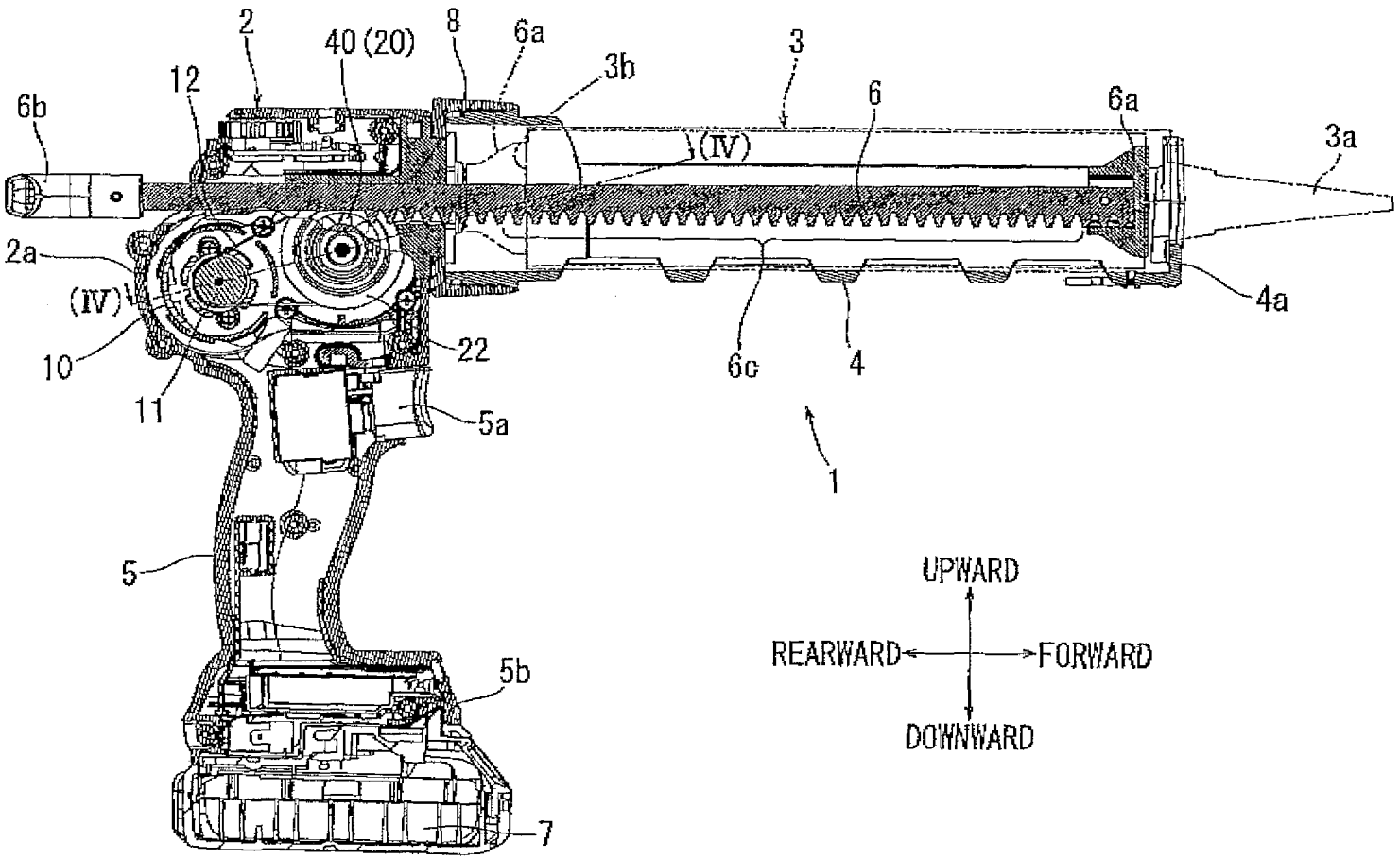
FIG. 2 is a vertical sectional view illustrating the internal structure of the caulking gun.
Figure 3:
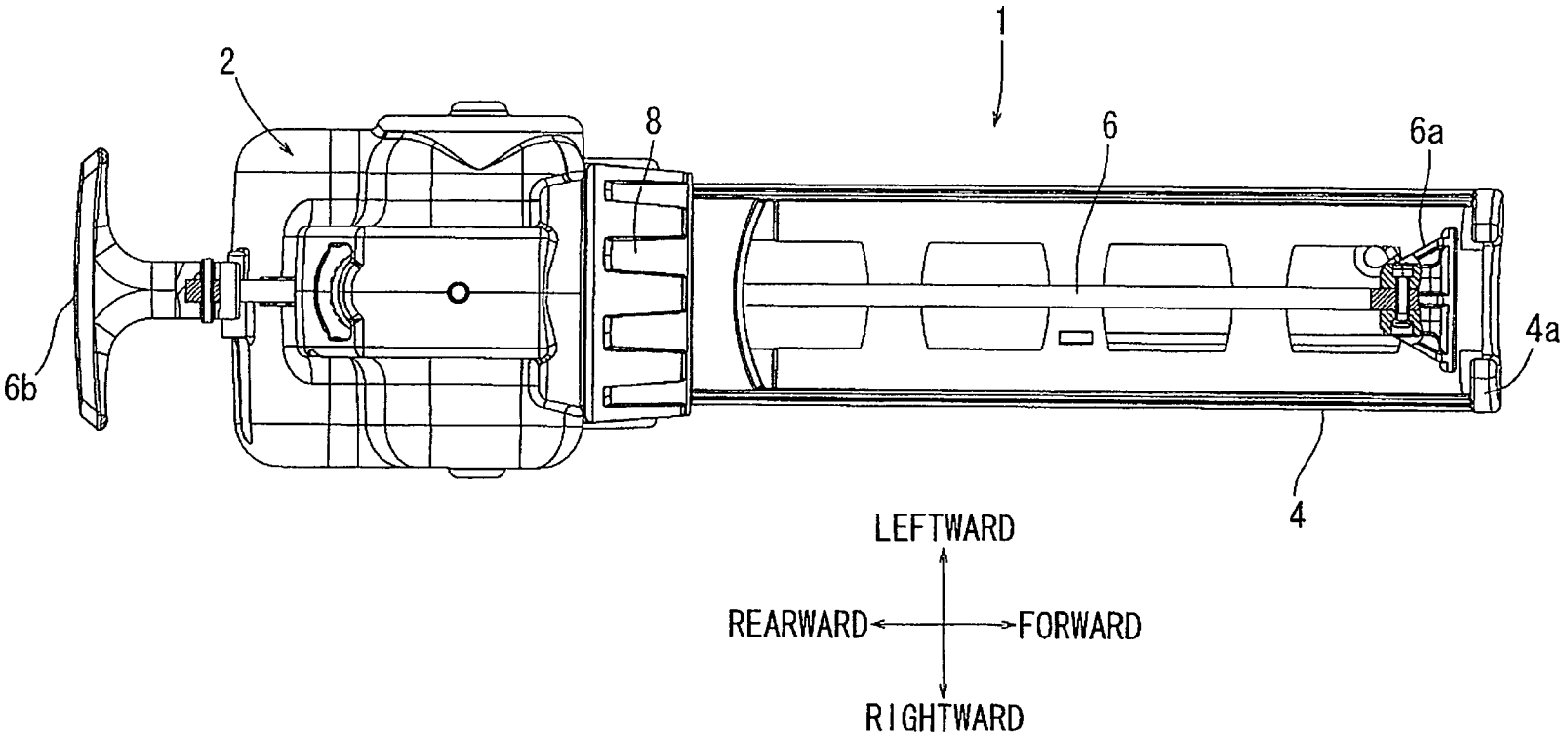
FIG. 3 is a plan view of the caulking gun as viewed in a direction indicated by arrow in FIG. 1.

An embodiment of the present invention will now be described with reference to FIGS. 1 through 7. FIGS. 1 through 3 show an electric caulking gun 1 according to the present embodiment. The caulking gun 1 may generally include a main body portion 2 having an electric motor 10 disposed therein for serving as a drive source, a cartridge setting portion 4, through which a cartridge 3 accommodating a caulking material can be set, and a handle portion 5 to be grasped by the user.

The cartridge setting portion 4 is disposed at the front portion of the main body portion 2 so as to protrude forward therefrom. The cartridge setting portion 4 may have a semi-cylindrical tubular shape for holding the cartridge 3 from below, so that a nozzle 3*a* of the cartridge 3 may protrude forward from a front end portion 4*a* of the cartridge setting portion 4. The cartridge setting portion 4 can be detached from the main body portion 2 by loosening a threaded fixing sleeve 8.

A push rod 6 may protrude forward from the front portion of the main body portion 2. This push rod 6 is movable in forward and rearward directions within the cartridge setting portion 4. At the front end of this push rod 6, there is provided a push plate 6*a* to be pressed against an extrusion surface 3*b* of the cartridge 3. Referring to FIG. 2, the push rod 6 can move between a front stroke end and a rear stroke end, where the push plate 6*a* is positioned as indicated by solid lines and chain double-dashed lines, respectively, as shown in FIG. 2. The rear end portion of the push rod 6 may protrude rearwards from the main body portion 2. A grip 6*b* may be provided at the rear end portion and can be gasped by the user for pulling the push rod 6. On the lower surface of the push rod 6, there is provided a rack portion 6*c* extending along the longitudinal direction thereof. This rack portion 6*c* may mesh with a drive gear 40 that will be described later. In a power transmission state, the push rod 6 advances via a power transmission mechanism including a rack/pinion mechanism formed by the rack portion 6*c* and the drive gear 40.

The handle portion 5 is provided so as to protrude downwardly from the lower portion of the main body portion 2. On the front side of the base portion of the handle portion 5, there is provided a switch lever 5*a* to be pulled by a fingertip of the hand of the user gasping the handle portion 5. When the switch lever 5*a* is pulled (i.e., turned on), an electric motor 10 provided inside the main body portion 2 starts to rotate in a normal direction. When the pulling operation is released (i.e., turning-off operation is performed), the electric motor 10 stops after being slightly rotated in a reverse direction. A battery attachment portion 5*b* is provided at the lower end portion of the handle portion 5. A battery pack 7 may be attached to the battery attachment portion 5*b*. The electric motor 10 rotates with a supply of power from the battery pack 7. The battery pack 7 may be a rechargeable batter and may be repeatedly used by being detached from the battery attachment portion 5*b* and recharged by a charger separately prepared.

Figure 4:
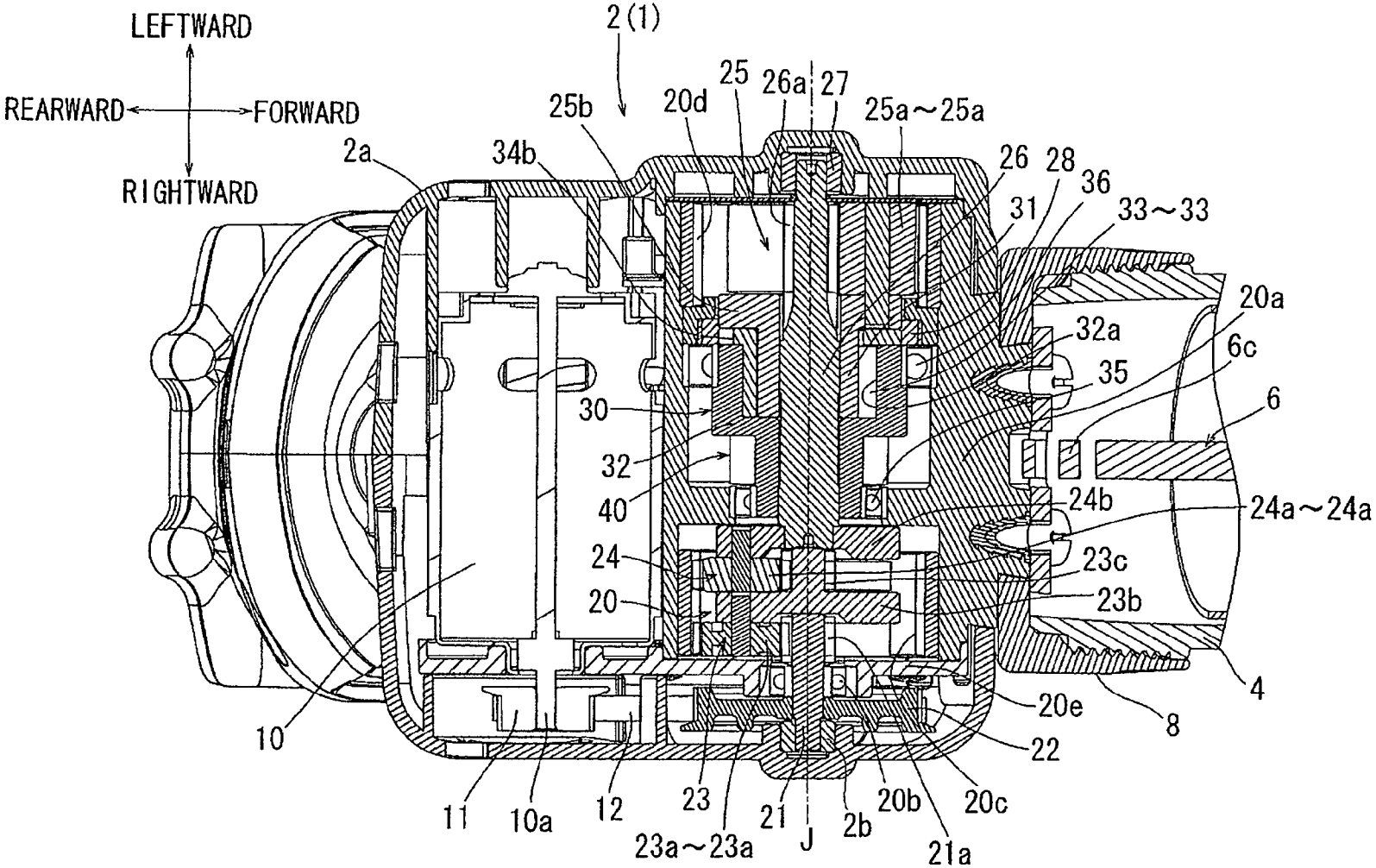
FIG. 4 is a cross-sectional view taken along line IV-IV in FIG. 2 and showing a drive unit.

FIG. 4 shows the internal structure of the main body portion 2. The electric motor 10 may be disposed within a rear portion of a main body housing 2*a* of the main body portion 2. A drive pulley 11 may be mounted to an output shaft 10*a* of the electric motor 10. A reduction gear mechanism 20 is disposed on the front side of the electric motor 10. An input shaft 21 of the reduction gear mechanism 20 is arranged so as to be rotatable about an axis J that may be parallel to the output shaft 10*a* of the electric motor 10. A driven pulley 22 having a larger diameter than the drive pulley 11 may be mounted to the input shaft 21. A transmission belt 12 may extend between the drive pulley 11 and the driven pulley 22. Due to this belt transmission mechanism, the rotational power of the electric motor 10 is reduced at a fixed reduction ratio before being input to the reduction gear mechanism 20.

The reduction gear mechanism 20 may include a first stage planetary gear train 23, a second stage planetary gear train 24, a third stage planetary gear train 25, and a transmission state switching device 30. The input shaft 21 is rotatably supported by the right-hand side portion of a main body housing 2*a* via a bearing 2*b* and is also rotatably supported by the right-hand side portion of a housing cover 20*e* via a bearing 20*b*. On this input shaft 21, there is formed a first-stage sun gear 21*a* of the first-stage planetary gear train 23. Three first-stage planetary gears 23*a* are in mesh with the first-stage sun gear 21*a*. Each first-stage planetary gear 23*a* is in mesh with a right-hand side internal gear 20*c* mounted within the right-hand side portion of a gear housing 20*a*. The three first-stage planetary gears 23*a* are rotatably supported by a first-stage carrier 23*b*. A second-stage sun gear 23*c* of the second-stage planetary gear train 24 is formed on the first-stage carrier 23*b*. The three second-stage planetary gears 24*a* are in mesh with the second-stage sun gear 23*c*. The second-stage planetary gears 24*a* are also in mesh with the above-mentioned right-hand side internal gear 20*c*. The three second-stage planetary gears 24*a* are rotatably supported by a second-stage carrier 24*b*. A drive shaft 26 is connected to the second-stage carrier 24*b*. In this way, the rotational power of the electric motor 10 reduced by the belt transmission mechanism is further reduced by the above-mentioned first-stage and second-stage planetary gear trains 23 and 24 before being transmitted to the drive shaft 26.

The drive shaft 26 is arranged on the same axis as the input shaft 21. Accordingly, the drive shaft 26 is rotatable about the axis J that is parallel to the output shaft 10*a* (rotational axis) of the electric motor 10. The drive shaft 26 extends to the left-hand side portion within the main body portion 2. The left-hand side end portion of the drive shaft 26 is rotatably supported by the main body housing 2*a* via a bearing 27. A third-stage sun gear 26*a* of the third planetary gear train 25 is formed on the loft-hand end portion of the drive shaft 26. The three third-stage planetary gears 25*a* are in mesh with the third-stage sun gear 26*a*. Each third-stage planetary gear 25*a* is in mesh with a left-hand side internal gear 20*d* mounted within the left-hand side portion of the gear housing 20*a*. The three third-stage planetary gears 25*a* are rotatably supported by a third-stage carrier 25*b*.

In this way, the rotational power of the drive shaft 26 is further reduced by the third-stage planetary gear train 25 before being input to the transmission state switching device 30. As shown in the drawing, this transmission state switching device 30 is coaxial with the drive shaft 26, and is positioned substantially centrally with respect to the right and left widthwise direction of the main body portion 2. When the drive shat 26 or the electric motor 10 rotates in a normal direction, the rotational force may be transmitted to the drive gear 40 via the transmission state switching device 30, so that the push rod 6 in mesh with the drive gear 40 moves forward.

Here, the transmission path for the rotational power from the electric motor 10 to the drive gear 40 will be described. First, at the right-hand end portion of the main body portion 2, the rotational power is input to the input shaft 21 via the belt transmission type reduction mechanism. The rotational power input to the input shaft 21 is output to the drive shaft 26 via the first-stage and second-stage gear trains 23 and 24. At the left-hand end portion thereof, the rotational power transmitted to the drive shaft 26 is input to the third-stage planetary gear train 25. Regarding the third-stage planetary gear train 25, the orientation with respect to the right and left direction thereof (the positional relationship of the third-stage carrier 25*b* with respect to the third-stage sun gear 26*a*) is opposite that of the first-stage and second-stage planetary gear trains 23 and 24. The rotational power input to the third-stage planetary gear row 25 is transmitted to the drive gear 40 via the transmission state switching device 30.

In this way, the transmission path of the rotational power of the electric motor 10 input from the right-hand end side of the main body portion 2 is oriented from the right-hand end side of the main body portion 2 to the left-hand end side thereof, and the orientation is then reversed to return to the center with respect to the right and left widthwise direction of the main body portion 2 for transmission to the drive gear 40, thus forming a I-shaped transmission path. With this transmission path for the rotational power, it is possible to arrange a larger number of stages of reduction gear trains (planetary gear train) on the axis J, and to obtain a large reduction ratio while achieving a reduction in the size in the widthwise direction of the main body portion 2. Further, it is possible to arrange the push rod 6 across the center with respect to the widthwise direction of the main body portion 2.

Figure 5:
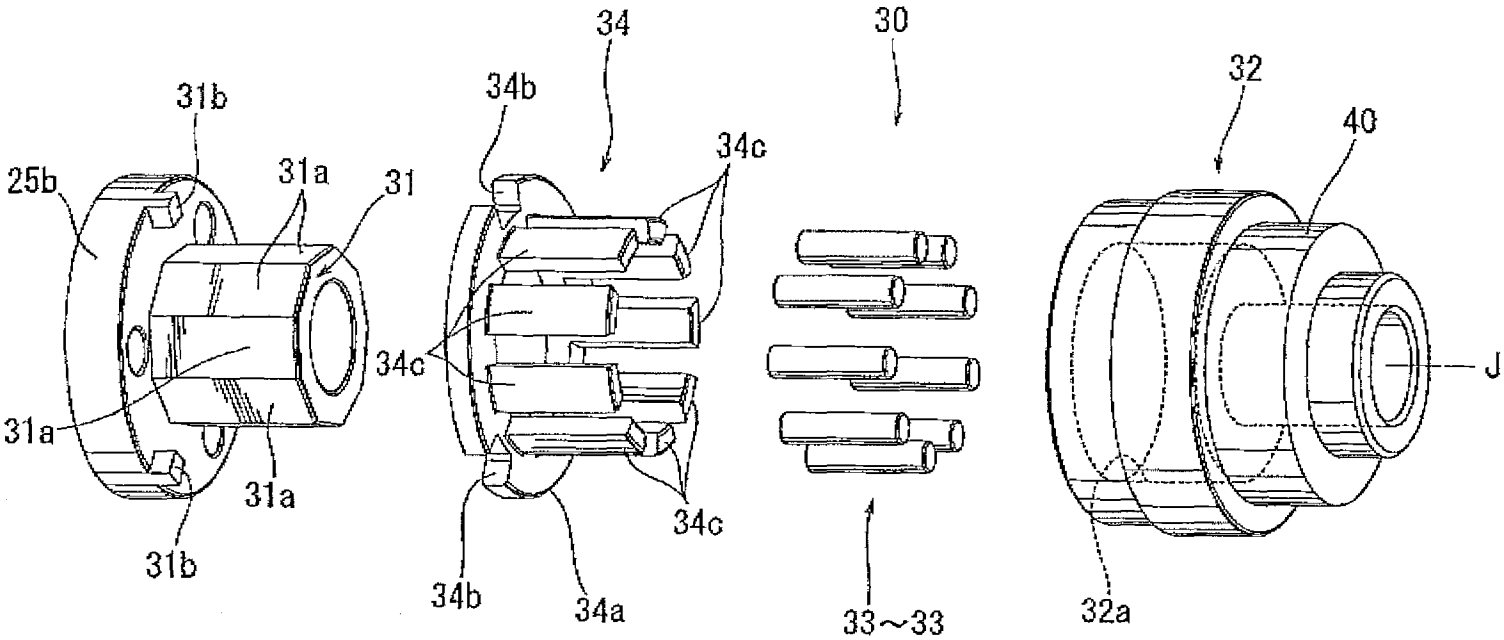
FIG. 5 is an exploded perspective view of a transmission state switching device.
Figure 6:
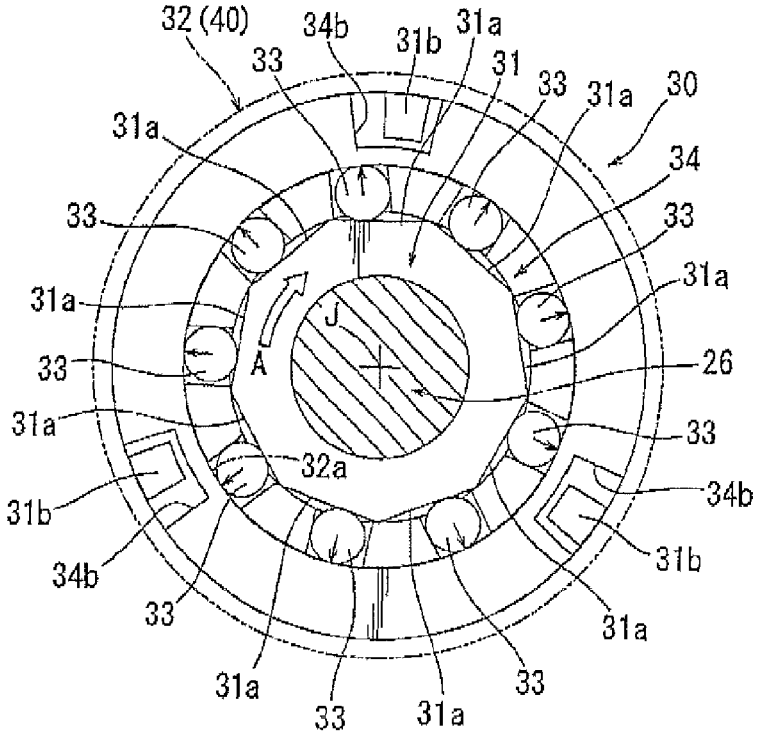
FIG. 6 is a cross-sectional view of the transmission state switching device in a power transmission state.
Figure 7:
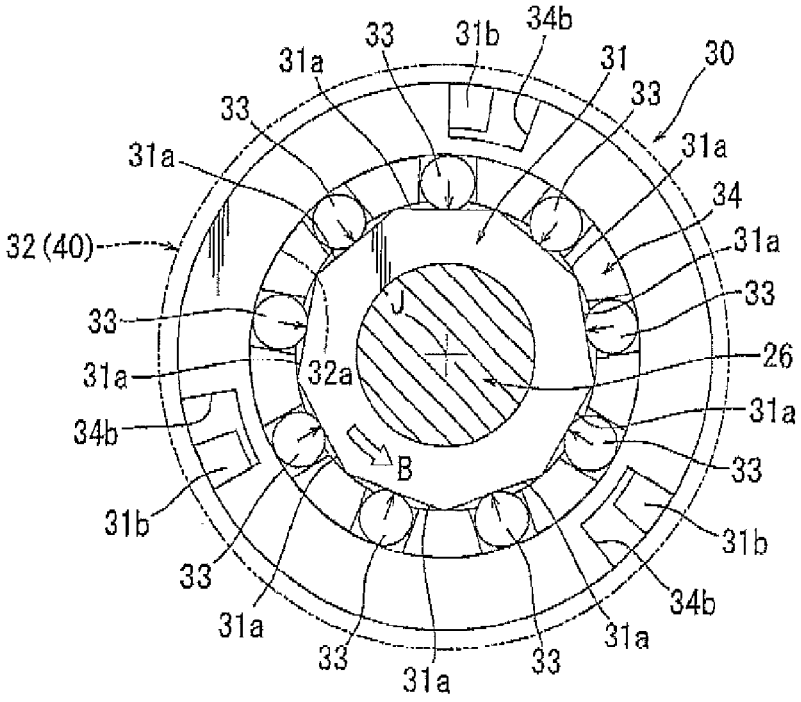
FIG. 7 is a cross-sectional view of the transmission state switching section in a transmission interruption state.

FIGS. 5 through 7 illustrate the transmission state switching device 30 in detail. The transmission state switching device 30 may include an upstream side transmission member 31, a downstream side transmission member 32 and a plurality of power transmission pins 33 provided between the upstream side transmission member 31 and the downstream side transmission member 32. The upstream side transmission member 31 may be disposed coaxially and integrally with the third-stage carrier 25*b* that is an upstream side member with respect to the power transmission path. The downstream side transmission member 32 may be formed integrally with on the drive gear 40.

The upstream side transmission member 31 may be formed as a nonagon prism shape having nine flat transmission switching surfaces 31*a* formed on the outer peripheral surface thereof. Each transmission switching surface 31*a* is in contact with one power transmission pin 33. A pin holder 34 may retain the nine power transmission pins 33 at substantially equal intervals along a circle. As shown in the drawing, the pin holder 34 is integrally provided with a total of nine support pillars 34*c* arranged along a circle. The nine support pillars 34*c* extend parallel to each other in the direction of the axis J. One power transmission pin 33 is retained between two adjacent support pillars 34*c* so as to be capable of displacement in the radial direction of the pin holder 34. Three engagement recesses 34*b* are formed in a flange portion 34*a* of the pin holder 34. The three engagement recesses 34*b* are arranged at three positions that are at equal intervals in the circumferential direction. In correspondence with the three engagement recesses 34*b*, there are provided three engagement protrusions 31*b* on the right-hand end surface of the third-stage carrier 25*b*. When the three engagement protrusions 31*b* are respectively moved into the engagement recesses 34*b*, the flange portion 34*a* may contact with the right-hand side surface of the third-stage carrier 25*b*, whereby the nine power transmission pins 33 are arranged at equal intervals in the circumferential direction on the outer peripheral side of the upstream side transmission member 31 through the intermediation of the pin holder 34.

Within a movable range of the engagement protrusions 31*b* relative to and within the engagement recesses 34*b*, the upstream side transmission member 31 is capable of relative rotation with respect to the pin holder 34. As a result of the relative rotation of the upstream side transmission member 31 with respect to the pin holder 34, each transmission, switching surface 31*a* is displaced in the circumferential direction with respect to each power transmission pin 33.

A rubber ring 28 having an annular configuration may slidably contact the outer circumferential surface of the third-stage carrier 25*b*. The rubber ring 28 may be fixed in position along the inner circumferential surface of the gear housing 20*a*. As a result of the sliding contact of the rubber ring 28 with the circumferential surface of the third-stage carrier 25*b*, an appropriate frictional resistance against rotation in the rotational direction of the third-stage carrier 25*b* may be produced. Due to this appropriate resistance, the rotation al position of the third-stage carrier 25*b* is maintained when the electric motor 10 is at rest (i.e., in the rotation-free state).

Each power transmission pin 33 may be retained between the transmission switching surface 31*a* of the upstream side transmission member 31 and the inner circumferential surface (power transmission surface 32*a*) of the downstream side transmission member 32. Thus, when each transmission switching surface 31*a* is displaced in the circumferential direction with respect to each power transmission pin 33 through the relative rotation of the upstream side transmission member 31 with respect to the pin holder 34, the distance between the power transmission surface 32*a* of the downstream side transmission member 32 and each transmission switching surface 31*a* of the upstream side transmission member 31 may be changed.

As the upstream side transmission member 31 makes relative displacement with respect to the pin holder 34 in the normal rotational direction (clockwise as seen in FIG. 6) as indicated by outline arrow A in FIG. 6 by the on-operation of the switch lever 5*a*, the distance between the power transmission surface 32*a* of the downstream side transmission member 32 and each transmission switching surface 31*a* of the upstream side transmission member 31 may be reduced with respect to each power transmission pin 33. As the distance between the surfaces 32*a* and 31*a* is reduced, the power transmission pins 33 may be clamped between the surfaces 32*a* and 31*a* so as to be engaged with (wedged against) the surfaces 32*a* and 31*a*, whereby a power transmission state may be achieved to transmit the normal rotation of the upstream side transmission member 31 to the downstream side transmission member 32. As shown in FIG. 6, at this stage, the engagement protrusions 31*b* are not in contact with the end portions of the engagement recesses 34*b*, so that the rotational power of the upstream side transmission member 31 can be reliably transmitted to the downstream side transmission member 32 by way of engagement of the power transmission pins 33.

In contrast, when the switch lever 5*a* is operated to be switched off, the electric motor 10 may be stopped after being slightly rotated in the reverse direction. As shown in FIG. 7, as the electric motor 10 is slightly rotated in the reverse direction, the upstream side transmission member 31 makes relative displacement in the reverse direction (in the counterclockwise direction as viewed in FIG. 7) indicated by outline arrow B with respect to the pin holder 34, and the distance between the power transmission surface 32*a* and the transmission switching surface 31*a* becomes maximum with respect to each power transmission pin 33. When the distance between the surfaces 32*a* and 31*a* has become maximum, the clamping state of the power transmission pins 33 between the surfaces 32*a* and 31*a* may be released, so that a transmission interruption state may be achieved to interrupt transmission of power from the upstream side transmission member 31 to the downstream side transmission member 32. As shown in FIG. 7, at this stage, the engagement protrusions 31*b* may contact with the end portions of the engagement recesses 34*b*, so that the relative rotation in the reverse direction of the upstream side transmission member 31 with respect to the pin holder 34 can be restricted. In this state, each power transmission pin 33 is situated at the center of the transmission switching surface 31*a*, so that the distance between the transmission switching surface 31*a* and the power transmission surface 32*a* may be a maximum distance. Thus, the clamping state of the power transmission pins 33 is kept released, so that the transmission interruption state is maintained. This transmission interruption state of the transmission state switching device 30 may be maintained even after the electric motor 10 has been stopped.

As described above, the rubber ring 28 is in sliding contact with the circumferential surface of the third-stage carrier 25*b* to maintain the rotational position thereof. Therefore, the rotation stop position of the third-stage carrier 25*b* and eventually that of the upstream side transmission member 31 may be maintained when the electric motor 10 has been stopped. This may also help to reliably maintain the transmission interruption state when the electric motor 10 has been stopped.

In this way, as the upstream side transmission member 31 makes relative rotation in the normal direction indicated by the outline arrow A in FIG. 6 through the normal rotation of the electric motor 10, the transmission state switching device 30 may be brought to the power transmission state shown in FIG. 6, and the rotational power is transmitted to the downstream side transmission member 32. As the upstream side transmission member 31 makes relative rotation to the reverse direction as indicated by the outline arrow B in FIG. 7 through slight rotation in the reverse direction of the electric motor 10 as a result of the switching-off of the switch lever 5*a*, the transmission state switching device 30 is brought to the transmission interruption state in which the transmission of power between the upstream side transmission member 31 and the downstream side transmission member 32 is interrupted. In this transmission interruption state, the push rod 6 may be separated from the rotational power transmission path of the electric motor 10 so as to be movable independently. Therefore, the push rod 6 may be brought to a free-movement-possible state in which it can be advanced by pushing the grip 6*b* manually forwards while grasping the grip 6*b* and in which, conversely, it can be retreated by pulling the grip 6*b* backwards.

The downstream side transmission member 32 is rotatably supported by the gear housing 20*a* via bearings 35 and 36. This downstream side transmission member 32 is also rotatable about the axis J. The drive gear 40 is provided on the outer circumferential surface of the downstream side transmission member 32. As shown in FIG. 4, the drive gear 40 is situated substantially at the center in the right and left widthwise direction of the main body portion 2. Thus, the push rod 6 having the rack portion 6*c* in mesh with the drive gear 40 is arranged so as to be capable of advancing and retreating in the forward and rearward directions across substantially the center in the right and left widthwise direction of the main body portion 2.

In the transmission interruption state when the electric motor 10 is at rest, the push rod 6 is in the free-movement-possible state. In this free-movement-possible state, it is possible to restore the push rod 6 backwards by grasping its grip 6*b* and pulling it manually backwards. When the push rod 6 has been retreated by pulling it backwards, it is possible to place the cartridge 3 on the cartridge setting portion 4. After the cartridge 3 has been placed on the cartridge setting portion 4, the push rod 6 in the free-movement-possible state is manually pushed forwards, and the push plate 6*a* thereof is brought into contact with the extrusion surface 3*b* of the cartridge 3. In this way, the setting of the cartridge 3 is completed.

When the user pulls the switch lever 5*a* with a fingertip of his or her hand grasping the handle portion 5, the electric motor 10 is started to rotate in the normal direction. The rotation of the electric motor 10 is reduced by the belt reduction mechanism formed by the drive pulley 11 and the driven pulley 22 between which the transmission belt 12 extends, and is then input to the reduction gear mechanism 20 to be further reduced. By the reduction gear mechanism 20, the rotation of the electric motor 10 is further reduced by the first through third-stage planetary gear trains 23 through 25. The rotation reduced by the first-stage and second-stage planetary gear trains 23 and 24 arranged on the right-hand side portion of the main body portion 2 is input to the third-stage planetary gear train 25 arranged on the left-hand side portion of the main body portion 2 via the drive shaft 26. After being reduced by the third-stage planetary gear train 25, the rotational power is input to the transmission state switching device 30 arranged substantially at the center in the right and left widthwise direction of the main body portion 2.

As long as the electric motor 10 rotates in the normal direction, a power transmission state is achieved by the transmission state switching device 30, in which the power transmission pins 33 are clamped and wedged between the transmission switching surfaces 31*a* of the upstream side transmission member 31 and the power transmission surface 32*a* of the downstream side transmission member 32. Due to this power transmission state, the rotational power of the electric motor 10 is output to the drive gear 40. As the drive gear 40 is rotated by the rotational power, the push rod 6 advances trough the mesh-engagement between the drive gear 40 and the rack portion 6*c*. As the push rod 6 advances, the extrusion surface 3*b* of the cartridge 3 is pushed in the dispensing direction by its push plate 6*b*, so that the caulking material contained in the cartridge 3 is dispensed from the nozzle 3*a*.

After a fixed amount of caulking material has been dispensed from the nozzle 3*a*, the user may release the pulling force of the switch lever 5*a* (i.e., performs turning-off operation), so that the electric motor 10 stops after being slightly reversed. As the electric motor 10 is reversed, the transmission state switching device 30 is switched to the transmission interruption state shown in FIG. 7 as described above. In the transmission interruption state, the push rod 6 is separated from the power transmission path of the electric motor 10, and is placed in the free-movement-possible state. When the push rod 6 is placed in the free-movement-possible state, the push rod 6 may be pushed backwards together with the extrusion surface 3*b* due to the residual pressure inside the cartridge 3, whereby it is possible to prevent so-called after-dripping from the nozzle 3*a*.

With the caulking gun 1 of this embodiment constructed as described above, the electric motor 10 is positioned within the main body 2 such that the electric motor 10 is balanced in weight in the right and left direction with respect to the push rod 6 that is positioned to extend substantially the central portion in the right and left widthwise direction of the main body 2. In other words, the electric motor 10 is positioned substantially centrally with respect to the right and left direction of the main body 2. Therefore, the electric motor 10 does not extend laterally by a large distance as in the known art but is accommodated entirely within the width in the right and left direction of the main body 2. Hence, the main body 2 is improved in balance in weight when the user holds the main body 2 by grasping the handle portion 5. As a result, the caulking gun 1 can be easily handled, and the caulking gun 1 is improved in operability.

In this embodiment, the arrangement of the electric motor 10 in the central position with respect to the right and left direction is achieved by setting the axis J parallel to the output shaft 10*a* of the electric motor 10 and arranging the first to third planetary gear trains 23 to 25 and the drive gear 40 on the axis 3 as described above. In other words, the electric motor 6 is arranged parallel to the axis J. More specifically, the axis of output shaft 10*a* of the electric motor 10 and the axis J extend substantially perpendicular to a vertical plane including a longitudinal axis of the push rod 6, and the vertical plane extends through a substantially central position with respect to the right and left direction of the electric motor 10.

In addition, in the above embodiment, the belt transmission type reduction mechanism is provided between the output shaft 10*a* of the electric motor 10 and the reduction gear mechanism 20. As compared with the gear mesh-engagement type reduction mechanism, the belt transmission type reduction mechanism can provide a higher reduction ratio without involving an increase in the distance between the output shaft 10*a* of the electric motor 10 and the drive shaft 26, so that it is possible to achieve a reduction in the size, mainly in the forward and rearward direction, of the main body portion 2 and eventually the size of the caulking gun 1.

In addition, in the above embodiment, the rotational power of the electric motor 10 is transmitted along the transmission path from the right-hand end side to the left-hand end side of the main body portion 2 by way of the belt transmission type reduction mechanism and the first and second planetary gear trains 23 and 24, and is there after transmitted to the drive gear 40 along the transmission path reversed to return to the center with respect to the right and left widthwise direction of the main body portion 2 by way of the third planetary gear train 25, thus forming a J-shaped transmission path. Therefore, it is possible to arrange a larger number of stages of reduction gear trains (planetary gear train) on the axis 3, and to obtain a large reduction ratio while achieving a reduction in the size in the widthwise direction of the main body portion 2. Further, it is possible to arrange the push rod 6 across the center with respect to the widthwise direction of the main body portion 2.

The above-described embodiment may be modified in various ways. For example, in the above embodiment, the vertical plane including the longitudinal axis of the push rod 6 extends through a substantially central position with respect to the right and left direction of the electric motor 10. However, the vertical plane of the push rod 6 may extend through the other position of the electric motor 10. For example, the vertical plane of the push rod 6 may extend through the left end portion or the right end portion of the electric motor 10. Thus, it may be possible to improve the weight balance by positioning the electric motor 10 such that the push rod 6 is positioned within the length of the electric motor 10 as viewed in a plan view.

Further, while in the above embodiment the rotation of the electric motor 10 is reduced by the belt transmission mechanism in which the transmission belt 12 extends between the drive pulley 11 and the driven pulley 22, the reduction may be effected through mesh-engagement of gears.

Further, while in the above embodiment three stages of planetary gear trains 23 through 25 are provided in the reduction gear mechanism 20, the reduction may also be effected by one or two stages of planetary gear trains; or, conversely, by four or more stages of planetary gear trains. In this case, it is possible to effect the reduction by providing one or two stages of planetary gear trains respectively on both sides of the main body portion 2.

Further, while in the above-described embodiment nine power transmission pins 33 are provided in the transmission state switching device 30, it is also possible to attain the same effect by providing the power transmission pins in a number not more than eight or in a number not less than ten.

What is claimed is:

1. An electric caulking gun comprising:

an electric motor having an output shaft extending in a left and right direction;

a gear mechanism coupled to the output shaft of the electric motor and including a drive gear, the drive gear having a gear axis extending in the left and right direction;

a push rod coupled to the drive gear of the gear mechanism, so that the push rod moves forward and backward as the electric motor is driven;

a main body portion configured to accommodate therein the electric motor and the gear mechanism;

a handle portion disposed on a lower side of the main body portion; and a battery pack disposed below the handle portion;

wherein the push rod is centrally located within the main body portion with respect to the left and right direction;

wherein the electric motor is weight balanced with respect to the push rod with respect to the left and right direction;

wherein the gear mechanism is disposed on a front side of the electric motor; and wherein the electric motor and the gear mechanism are disposed directly below the push rod.

2. The electric caulking gun according to claim 1, wherein the gear axis of the drive gear of the gear mechanism is disposed on an upper side of the output shaft of the electric motor.

3. The electric caulking gun according to claim 1, further comprising a switch lever disposed at the handle portion, wherein the gear mechanism is located at a position between the push rod and the switch lever.

4. The electric caulking gun according to claim 1, further comprising a belt transmission mechanism coupled between the output shaft of the electric motor and an input shaft of the gear mechanism.

* * * * *